US007220143B2

(12) United States Patent
Graves

(10) Patent No.: US 7,220,143 B2
(45) Date of Patent: May 22, 2007

(54) OVERLAY TO PERMIT DELIVERY OF TELEPHONY AND MISSION-CRITICAL DATA SERVICES TO HOSPITAL-WIDE POINTS OF CARE

(75) Inventor: Alan F. Graves, Kanata (CA)

(73) Assignee: Nortel Networks Limited, St-Laurent, Quebec (CA)

( * ) Notice: Subject to any disclaimer, the term of this patent is extended or adjusted under 35 U.S.C. 154(b) by 0 days.

(21) Appl. No.: 10/857,978

(22) Filed: Jun. 2, 2004

(65) Prior Publication Data

US 2005/0272275 A1 Dec. 8, 2005

(51) Int. Cl.
*H01R 12/625* (2006.01)

(52) U.S. Cl. ..... 439/344; 439/638

(58) Field of Classification Search ..... 439/344, 439/638

See application file for complete search history.

(56) References Cited

U.S. PATENT DOCUMENTS 4,241,974 A * 12/1980 Hardesty ..... 439/638
4,407,559 A * 10/1983 Meyer ..... 439/536
4,477,141 A * 10/1984 Hardesty ..... 439/535
4,611,875 A * 9/1986 Clarke et al. ..... 439/638
4,756,695 A * 7/1988 Lane et al. ..... 439/76.1
5,291,399 A 3/1994 Chaco
5,465,082 A 11/1995 Chaco
5,594,786 A 1/1997 Chaco et al.
5,689,229 A 11/1997 Chaco et al.
5,822,544 A 10/1998 Chaco et al.
6,009,333 A 12/1999 Chaco
6,067,014 A * 5/2000 Wilson ..... 340/540
6,137,866 A * 10/2000 Staber et al. ..... 379/93.06
6,259,355 B1 7/2001 Chaco et al.
6,297,450 B1 * 10/2001 Yu ..... 174/66
RE37,531 E 1/2002 Chaco et al.
6,344,794 B1 2/2002 Ulrich et al.
6,373,944 B1 * 4/2002 Beavers ..... 379/438
6,462,656 B2 10/2002 Ulrich et al.
6,539,393 B1 3/2003 Kabala
6,825,763 B2 11/2004 Ulrich et al.
6,876,303 B2 4/2005 Reeder et al.
6,958,706 B2 10/2005 Chaco et al.
6,972,683 B2 12/2005 Lestienne et al.

(Continued)

OTHER PUBLICATIONS

Clinical Decision Support, Finding The Right Path; by Jane Metzge, Donna Stablein and Fran Turisco; First Consulting Group; Sep. 2002.

(Continued)

*Primary Examiner*—Truc Nguyen

(57) ABSTRACT

An overlay for a wall jack adapted to receive a telephony plug of a specific type. The overlay comprises a housing, as well as a telephony plug and a telephony socket on opposite faces of the housing. The telephony socket is adapted to receive a telephony plug of the specific type, and is equipped with a first physical lock mechanism for keeping the telephony plug of the specific type connected to the telephony socket. Also provided is a high-speed connector integrated to the housing, for connection to a mating connector leading to a digital apparatus, the high-speed connector being equipped with a second physical lock mechanism for keeping the mating connector connected to the high-speed connector. The second lock mechanism is designed to be more resistant to tension-induced disconnect than the first lock mechanism.

20 Claims, 9 Drawing Sheets

U.S. PATENT DOCUMENTS

| | | | |
|---|---|---|---|
| 7,042,337 | B2 | 5/2006 | Borders et al. |
| 7,080,061 | B2 | 7/2006 | Kabala |
| 7,154,397 | B2 | 12/2006 | Zerhusen et al. |
| 2002/0044059 | A1 | 4/2002 | Reeder et al. |
| 2002/0183979 | A1 | 12/2002 | Wildman |
| 2003/0132845 | A1 | 7/2003 | McDaniel, III |
| 2004/0193449 | A1 | 9/2004 | Wildman et al. |
| 2005/0035862 | A1 | 2/2005 | Wildman et al. |
| 2005/0151641 | A1 | 7/2005 | Ulrich et al. |
| 2005/0168341 | A1 | 8/2005 | Reeder et al. |
| 2006/0282459 | A1 | 12/2006 | Kabala |

OTHER PUBLICATIONS

Computerized Physician Order Entry, A Look at the Vendor Marketplace and Getting Started; by Jane Metzger and Fran Turisco; First Consulting Group; Dec. 2001.

Leapfrog Patient Safety Standards; The Potential Benefits of Universal Adoption, by J.D. Birkmeyer, The Leapfrog Group, Nov. 2000.

Computerized Physician Order Entry; Costs, Benefits and Challenges; A case study approach, by First Consulting Group for Advancing Health in America and the Federation of America Hospitals, Jan. 2003.

A Primer on Physician Order Entry; First Consulting Group for the California Healthcare Foundation, Oakland, CA, Sep. 2000.

Cisco Long-Reach Ethernet Solution; Product Catalog, Dec. 2003; (pp. 1-6).

Cisco Long-Reach Ethernet Frequently Asked Questions; downloaded from www.cisco.com as early as Feb. 13, 2004.

Cisco LRE/VDSL (Long-Reach Ethernet/Very-High-Data-Rate DSL); downloaded from www.cisco.com as early as Feb. 13, 2004.

Cisco LRE CPE Hardware Installation Guide, totaling 106 pages, text part No. 78-11469-04, May 2003.

Physician Adoption of Technology Linked to Providing Benefits; Technology and Quality; by Barry P. Chaiken, MD, MPH; Reprinted with permission from the Journal of Quality Health Care, vol. 1, Issue No. 2, Apr./Jun. 2002.

* cited by examiner

OVERLAY TO PERMIT DELIVERY OF TELEPHONY AND MISSION-CRITICAL DATA SERVICES TO HOSPITAL-WIDE POINTS OF CARE

CROSS-REFERENCES TO RELATED APPLICATIONS

The present application is related in subject matter to the following U.S. patent applications, each of which is incorporated by reference herein:

- Ser. No. 10/813,230 entitled "Integrated And Secure Architecture For Delivery Of Communications Services In A Hospital" to Graves et al., filed Mar. 31, 2004;
- Ser. No. 10/813,358 entitled "Systems And Methods For Preserving Confidentiality Of Healthcare Information In A Point-Of-Care Communications Environment" to Graves et al., filed Mar. 31, 2004;
- Ser. No. 10/819,349 entitled "Systems And Methods For Preventing An Attack On Healthcare Data Processing Resources In A Hospital Information System" to Graves et al., filed Apr. 7, 2004;
- Ser. No. unknown, entitled "Communications System Using A Hospital Telephony Infrastructure To Allow Establishment Of Healthcare Information Sessions At Hospital-Wide Points Of Care" to Graves, filed on the same date as the present application.

FIELD OF THE INVENTION

The present invention relates generally to overlays for wall jacks and, in particular, to an overlay which permits delivery of telephony and mission-critical healthcare information services to hospital-wide points of care.

BACKGROUND OF THE INVENTION

The ability for healthcare users to interact with a hospital information system while at the point of care (POC), e.g., at a patient's bedside, is recognized as having the potential to dramatically reduce the incidence of certain medical complications.

Specifically, studies estimate that significant benefits are likely to arise through the provision of "computerized physician order entry" (CPOE), which consists of allowing healthcare users (e.g., doctors, nurses, orderlies, etc.) to place orders (e.g., prescription, blood test, clean towel, etc.) via a bedside location in the vicinity of the patient being treated. This simple yet elusive paradigm, dubbed "CPOE at the POC", has the potential effect of reducing human error due to temporary memory loss and mistakes in transcription. In addition, when coupled with real-time decision information support tools (DIST), CPOE provides healthcare users with an additional level of assurance that their diagnosis or treatment plan falls within generally accepted parameters.

For background reading on the CPOE-at-the-POC paradigm and its predicted impact, the reader is referred to the following references, hereby incorporated by reference herein:

- *Clinical Decision Support—Finding the Right Path*, by J. Metzger, D. Stablein and F. Turisco, First Consulting Group, September 2002
- *Computerized Physician Order Entry: Costs, Benefits and Challenges—A case Study Approach*, by First Consulting Group for Advancing Health in America and the Federation of American Hospitals, January 2003

- *Leapfrog Patient Safety Standards—The Potential Benefits of Universal Adoption*, by J. D. Birkmeyer, The Leapfrog Group, November 2000
- *Computerized Physician Order Entry: A Look at the Vendor Marketplace and Getting Started*, by J. Metzger, F. Turisco, First Consulting Group, December 2001
- *A Primer on Physician Order Entry*, by First Consulting Group for the California Healthcare Foundation, Oakland, Calif., September 2000

Conventionally, hospitals have attempted to deploy CPOE at the POC by providing multiple POC access points throughout the hospital in communication with the core hospital network. In some implementations, the POC access points are wired directly to the core hospital network. However, it is apparent that the addition of hundreds of high-speed wiring connections throughout an existing hospital is a highly intrusive exercise, causing the shutting down of rooms or entire wards until installation is complete, due to the need to open unclean areas such as ceilings, wall interiors, etc. to place and pull new data network cables.

Clearly, there remains a need in the healthcare industry for implementing a CPOE-at-the-POC solution in a relatively non-disruptive manner.

SUMMARY OF THE INVENTION

A broad aspect of the present invention seeks to provide an overlay for a wall jack adapted to receive a telephony plug of a specific type. The overlay comprises a housing having an interior face and an exterior face, a telephony plug on the interior face of the housing, the telephony plug suitable for insertion into the wall jack and a telephony socket integrated to the housing and accessible from the exterior face of the housing. The telephony socket is adapted to receive a telephony plug of the specific type, and is equipped with a first physical lock mechanism for keeping the telephony plug of the specific type connected to the telephony socket. Also provided is a high-speed connector integrated to the housing, for connection to a mating connector leading to a digital apparatus, the high-speed connector being equipped with a second physical lock mechanism for keeping the mating connector connected to the high-speed connector. The second lock mechanism is designed to be more resistant to tension-induced disconnect than the first lock mechanism. Finally, there is provided a combiner-splitter unit electrically connected to the telephony plug, to the telephony socket and to the high-speed connector.

This and other aspects and features of the present invention will now become apparent to those of ordinary skill in the art upon review of the following description of specific embodiments of the invention in conjunction with the accompanying drawings.

DETAILED DESCRIPTION OF THE EMBODIMENTS

Figure 1:
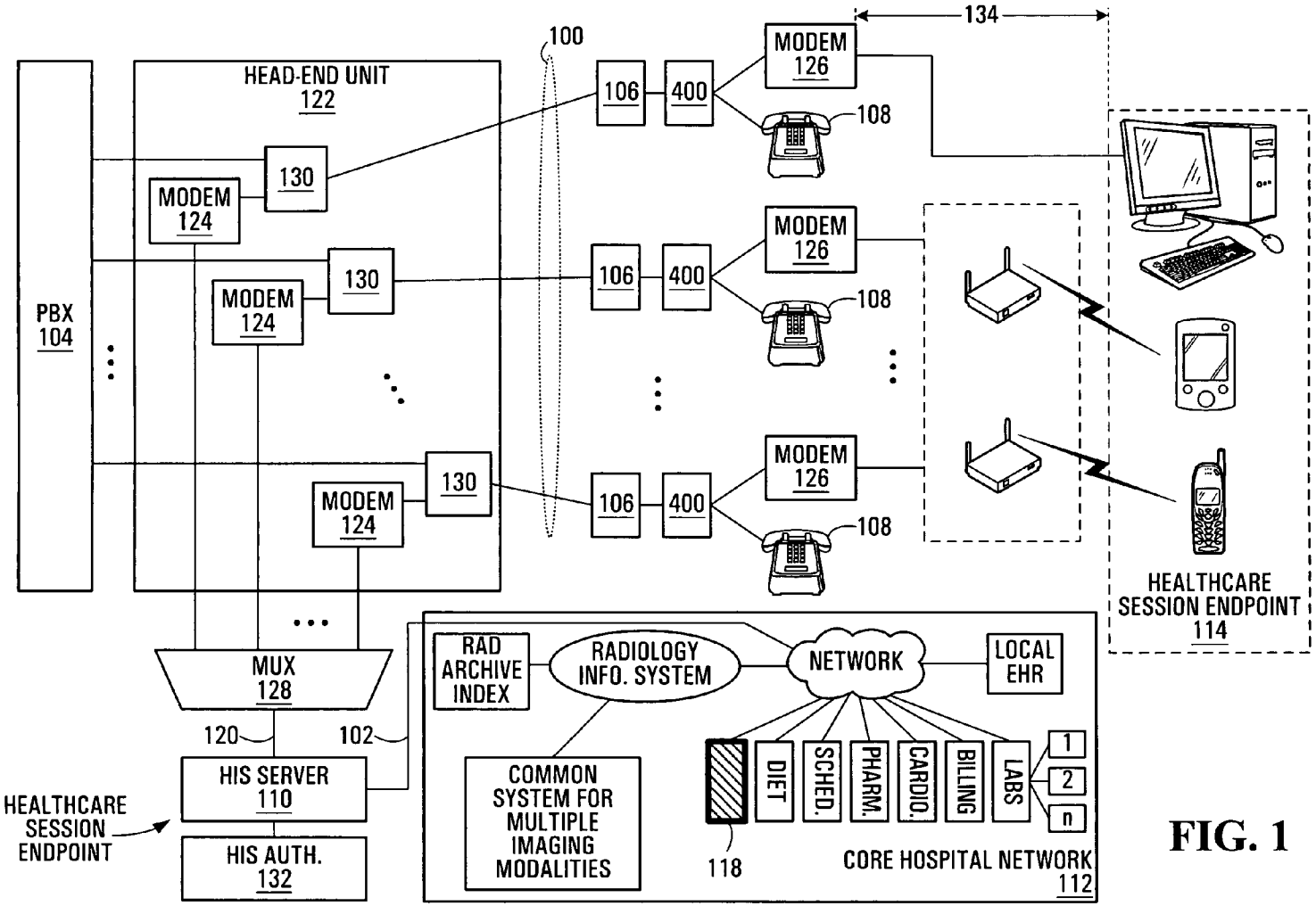
FIG. 1 shows, in block diagram form, a communications system in accordance with an embodiment of the present invention.

With reference to FIG. 1, there is shown a communications system in accordance with an embodiment of the present invention. The communications system is of particular use in a hospital environment that provides a twisted-pair telephony infrastructure 100 leading from a facility housing a private branch exchange (PBX) 104 to a plurality of wall jacks 106 in various rooms throughout the hospital. The PBX 104 provides telephony switching for telephony-band signals originated from, and destined for, a plurality of telephones 108 communicatively coupled to the wall jacks 106. The PBX 104 assigns logical "extensions" to different wall jacks 106, which allows both internal and external telephone calls to be routed to specific locations in the hospital.

In accordance with the present invention, healthcare (e.g., clinical) information (e.g., data or mixed VoIP/data) sessions are supported over the telephony infrastructure 100. The telephony infrastructure 100 can be part of a pre-existing wiring grid which extends in a ubiquitous manner throughout the hospital, notably with a phone jack at every patient bedside. The healthcare information sessions are end-to-end logical connections terminated at one end by a healthcare information system (HIS) server 110 connected to a core hospital network 112, and at the other end by user devices 114 that are intended for use primarily by healthcare workers, such as physicians, nurses, orderlies, etc. Examples of the end user devices 114 include but are not limited to a fixed-wire terminal, a WLAN-connected or wired computer on wheels (COW), a personal digital assistant, a WLAN-connected tablet computer, a WLAN wireless telephone, as well as composite devices combining these and other functions such as bar code scanning, etc.

Depending on the requirements of the healthcare information sessions, the HIS server 100 may need to interact in a rather high-speed manner with the core hospital network 112. This is achieved over a high-speed link 102 such as a Gigabit Ethernet link. The core hospital network 112 interconnects various hospital entities, such as radiology (connected to a PACS system), diet, scheduling, pharmacy, cardiology, billing, laboratories, local electronic health records, etc. The core hospital network 112 also maintains a healthcare authentication database 118, which contains information allowing healthcare users to be authenticated.

The healthcare authentication database 118 receives admissions input from a hospital admissions server (not shown). In an embodiment, the healthcare authentication database 118 comprises a collection of healthcare user identities and securely held corroborating evidence, along with an associated access profile for each healthcare user, which will include a dynamic patient access list based on the admissions input from the admissions server, together with a specific mapping of who has what accessible data, based upon professional qualifications, status and allocation to patient treatment teams, which itself may be dynamic, especially for shift workers such as nurses.

Thus, in the course of establishing healthcare information sessions with the user devices 114, the HIS server 110 controls authentication of the users purporting to establish these healthcare information sessions. With continued reference to FIG. 1, this can be achieved by providing access to a healthcare authentication entity 132 associated with the HIS server 110. The HIS 110 accesses the healthcare authentication entity 132 when an authentication request is received. The healthcare authentication entity 132 then accesses the healthcare authentication database 118 in the core hospital network 112 in order to indicate to the HIS server 110 when a user has been authenticated and the permissions associated with that user. However, it is possible that the number of authentication requests processed in this manner may be so large as to cause an overload of the healthcare authentication entity 132. Thus, a wireless security switch (such as the Nortel Networks 22xx product line) may be provided in association with the HIS 110, which allows only authentication requests from recognizable authorized devices to be passed to the healthcare authentication entity 132 from the HIS 110.

In order to transport data associated with healthcare information sessions over the telephony infrastructure 100 between the HIS server 110 and the user devices 114, a variety of transport legs is established. Accordingly, the HIS server 110 is connected by a high-speed link 120 to a head-end unit 122 which is itself connected to the PBX 104. The head-end unit 122 may reside in the facility that houses the PBX 104, such as a PBX room, or the head-end unit 122 may reside in an IT room, for example. The head-end unit 122 comprises a bank of centralized modems 124, each of which corresponds to a respective one of a plurality of remote modems 126 connected to a respective wall jack 106. The centralized modems 124 in the head-end unit 122 exchange digital information (e.g., packets) with the HIS server 110 over the high-speed link 120. A multiplexer 128 can be provided in order to allow multiple centralized modems 124 to communicate over the same high-speed link 120. The centralized modems 124 convert the digital information received from the HIS server 110 into out-of-telephony-band signals which are destined for respective ones of the remote modems 126. In the opposite direction of information flow, the centralized modems 124 convert out-of-telephony band signals sent from the remote modems 126 into digital information that is sent to the HIS server 110 over the high-speed link 120. The centralized modems 124 may also apply error control (such as forward error correction, cyclic redundancy check (CRC), etc.) to the out-of-telephony-band signals being exchanged with the remote modems 126.

Figure 2:
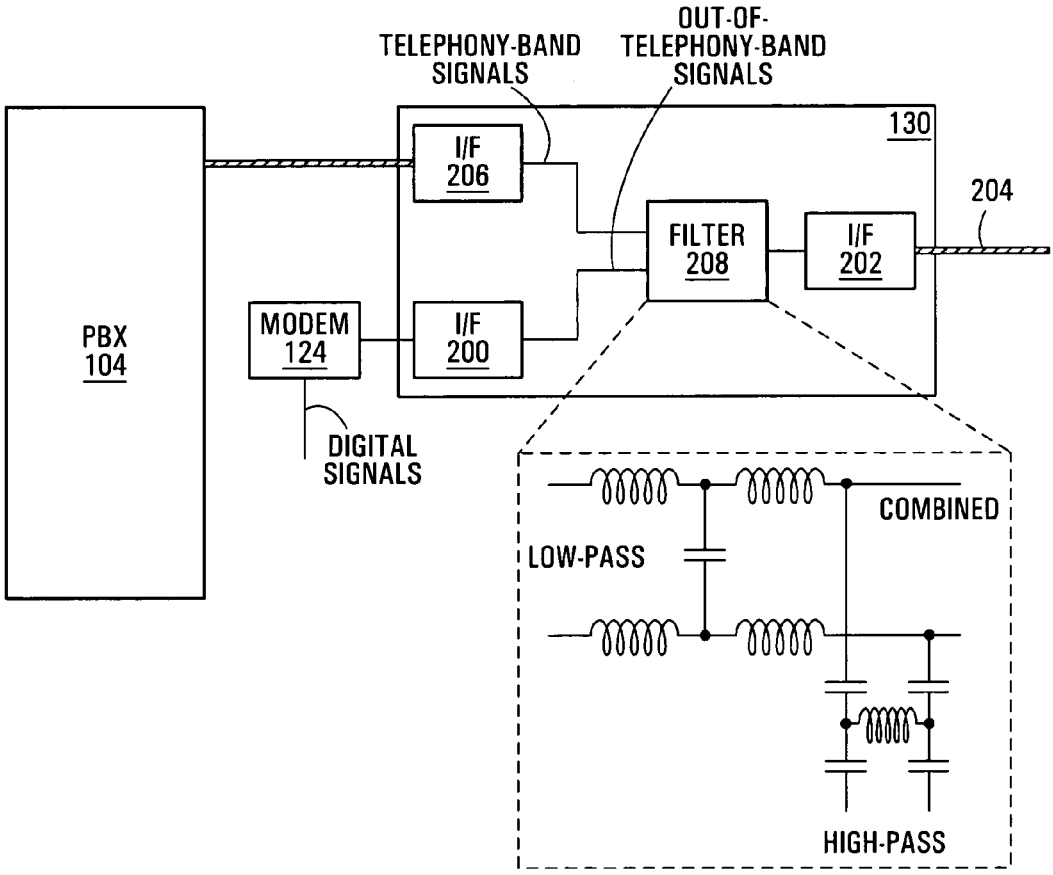
FIG. 2 is a detailed block diagram of a centralized combiner-splitter module.

The out-of-telephony-band signals sent and received by the centralized modems 124 are exchanged over the telephony infrastructure 100 using the same copper twisted pairs that transport the telephony-band signals handled by the PBX 104. In order to allow this functionality to take place, a bank of centralized combiner-splitter modules 130 is provided. As shown in greater detail in FIG. 2, each centralized combiner-splitter module 130 is associated with one of the centralized modems 124 and interfaces to the associated centralized modem 124 by a first interface 200. A second interface 202 is provided on each centralized combiner-splitter module 130 for interfacing with a twisted pair 204 and a third interface 206 is provided for interfacing with the PBX 104. A filter circuit 208 executes the functionality of the centralized combiner-splitter module 130, which is to permit the exchange of telephony-band signals with the PBX 104 over the twisted pair 204 while simultaneously permitting the exchange of out-of-telephony-band signals with the associated centralized modem 124 over that same twisted pair 204. Since practical implementations of the filter circuit 208 which achieve the desired functionality will be known to those skilled in the art, a further discussion of the details of the centralized combiner-splitter module 130 is not required, other than to say that it may comprise a combination of high-pass and low-pass filter elements.

It should be noted that in an example implementation, one or more centralized combiner-splitter modules 130 and the associated centralized modems 124 may reside on a single circuit card.

Figure 3:
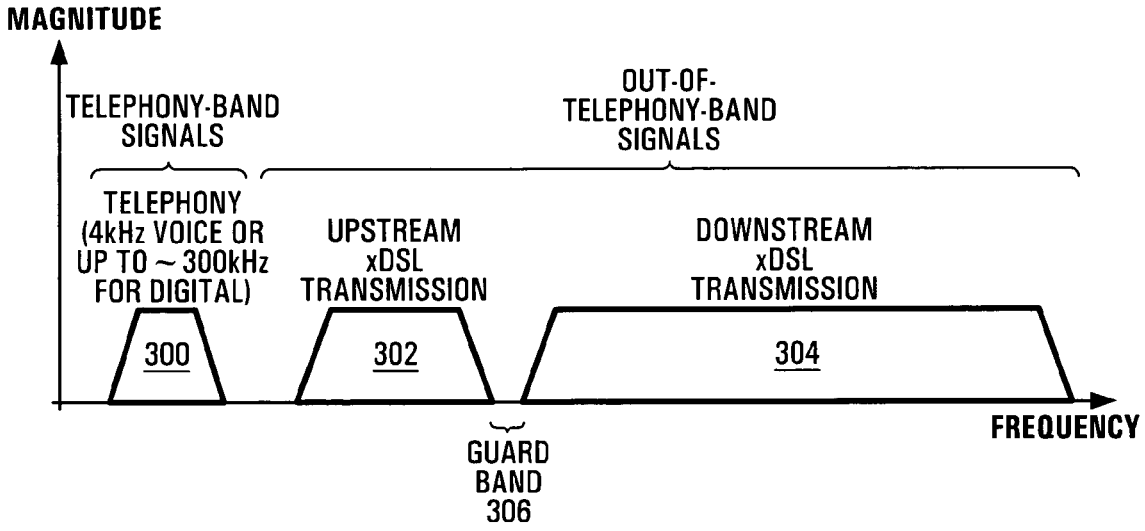
FIG. 3 illustrates a spectrum allocation scheme for the delivery of telephony-band signals and out-of-telephony-band signals.

The out-of-band telephony signals, which are sent and received by the centralized modems 124 over the telephony infrastructure 100, occupy spectral region that can be chosen as a matter of design and, as a result, may selected to be in accordance with existing standards, such as DSL, ADSL, VDSL, etc., referred to collectively as "xDSL". With reference to FIG. 3, xDSL operates in a simultaneous bidirectional mode by using different frequency bands outside the telephony band 300 for upstream 302 and downstream 304 transmission. A guard band 306 separates the upstream 302 and downstream 304 transmission bands. Several implementations for achieving this are already known, based upon bandwidth-efficient line coding techniques which match adaptively to the available channel path and extract close to the optimum reach over that path. For example, commonly used xDSL coding solutions are based upon Quadrature Amplitude Modulation (QAM) or Discrete Multi-Tone (DMT), although other coding schemes can be used. It is noted that between QAM and DMT, the latter usually offers a higher performance, but is also the more complex coding scheme of the two.

In the specific case of VDSL, advanced line coding permits a reach of up to approximately 1000 ft at 50 Mb/s downstream, 10 Mb/s return and up to approximately 3000 feet at 25 Mb/s downstream, 5 Mb/s return, which is more than adequate to cover most hospital sites. The MAC (Media Access Control) layer of a "54 Mb/s" 802.11a (the higher speed flavor of 802.11a/b) can deliver, under ideal conditions, a maximum of approximately 24–26 Mb/s of data with 1500-byte packets due to MAC inefficiencies so an available 25 Mb/s downstream VDSL feed will generally be fully adequate. In envisaged healthcare applications, the demand for upstream bandwidth is limited to a lower value than the downstream bandwidth, due to the nature of the services being delivered. For example, in CPOE, larger images are delivered to the user devices 114 but are rarely, if ever, generated at the user devices 114 or remote modems 126, as the imaging modalities are typically hard-wired into core hospital network 112. In any event, the upstream/downstream partitioning in VDSL need not be fixed, and the upstream capacity can be increased by moving the guard band 306 between the upstream 302 and downstream 304 bands higher in frequency and slightly reducing the downstream throughput. The placement of the guard band 306 is merely a matter of engineering optimization in the design of the system and is well within the knowledge of one skilled in the art.

Figure 4:
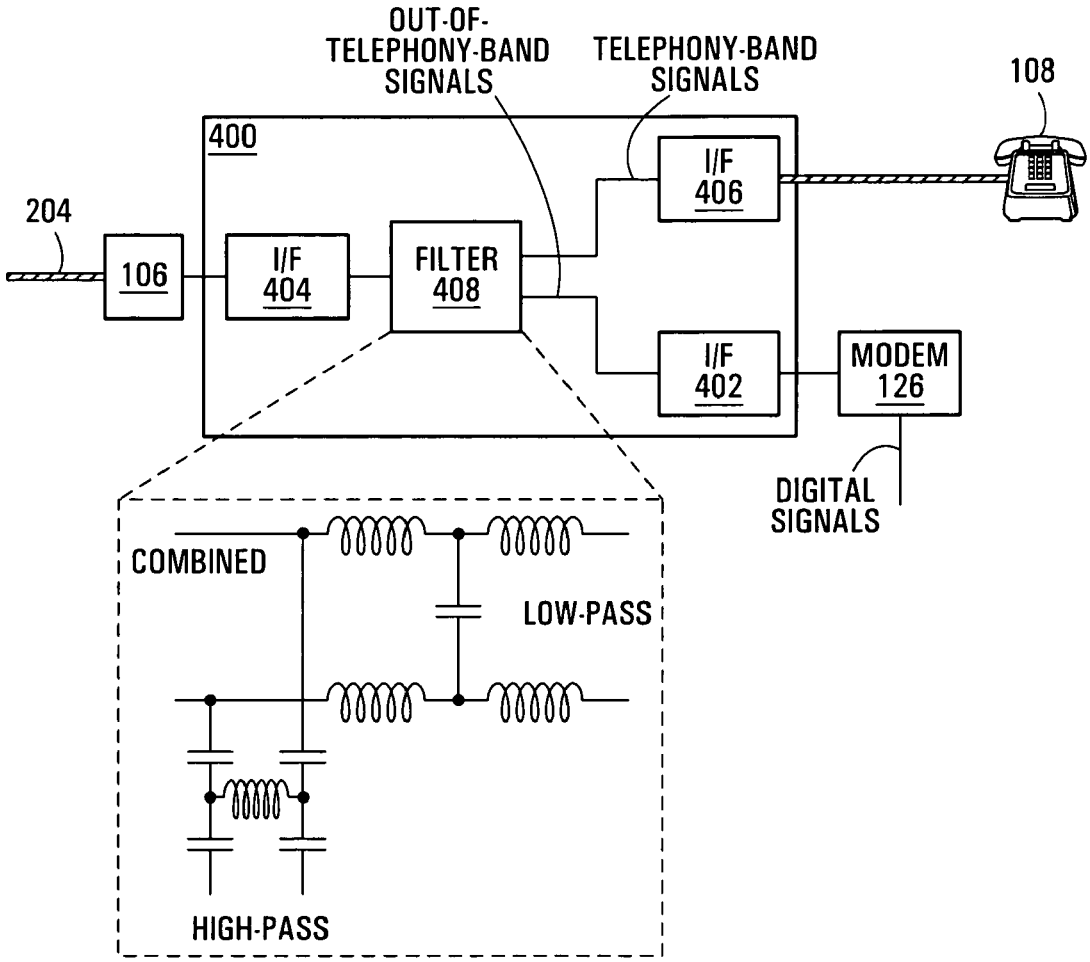
FIG. 4 is a detailed block diagram of a remote combiner-splitter module.

Reference is now made to FIG. 4. Since the twisted pair 204 which leads to the wall jack 106 carries both telephony-band signals and out-of-telephony-band signals, a remote combiner-splitter module 400 is provided between the wall jack 106 and the remote modem 126. The remote combiner-splitter module 400 is constructed and functions in much the same way as the centralized combiner-splitter module 130 at the other end of the twisted pair 204. Specifically, the remote combiner-splitter module 400 has a first interface 402 connected to the remote modem 126, a second interface 404 connected to the twisted pair 204 via the wall jack and a third interface 406 connected to a telephone 108. A filter circuit 408 allows the remote combiner-splitter module 400 to execute its main functionality, which is to permit the exchange of telephony-band signals with the telephone 108 over the twisted pair 204 while simultaneously permitting the exchange of out-of-telephony-band signals with the remote modem 126 over that same twisted pair 204.

Figure 5:
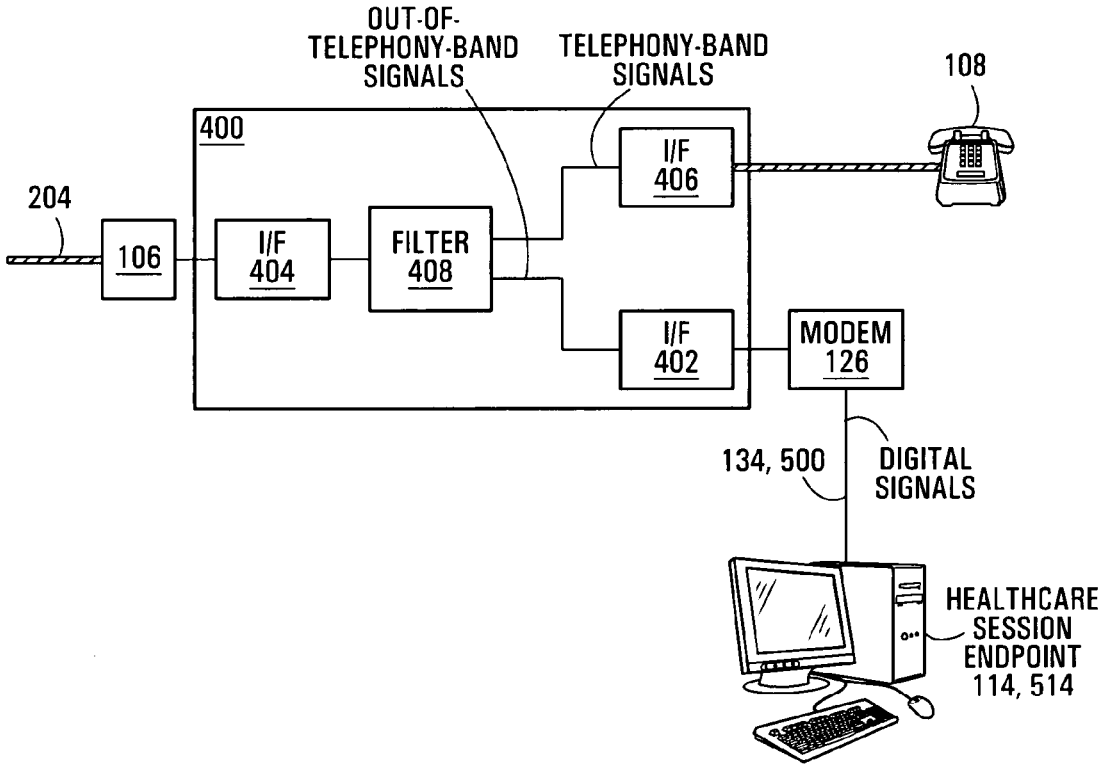
FIG. 5 is a block diagram showing a communication link between a remote modem and a fixed-wire user device.
Figure 6:
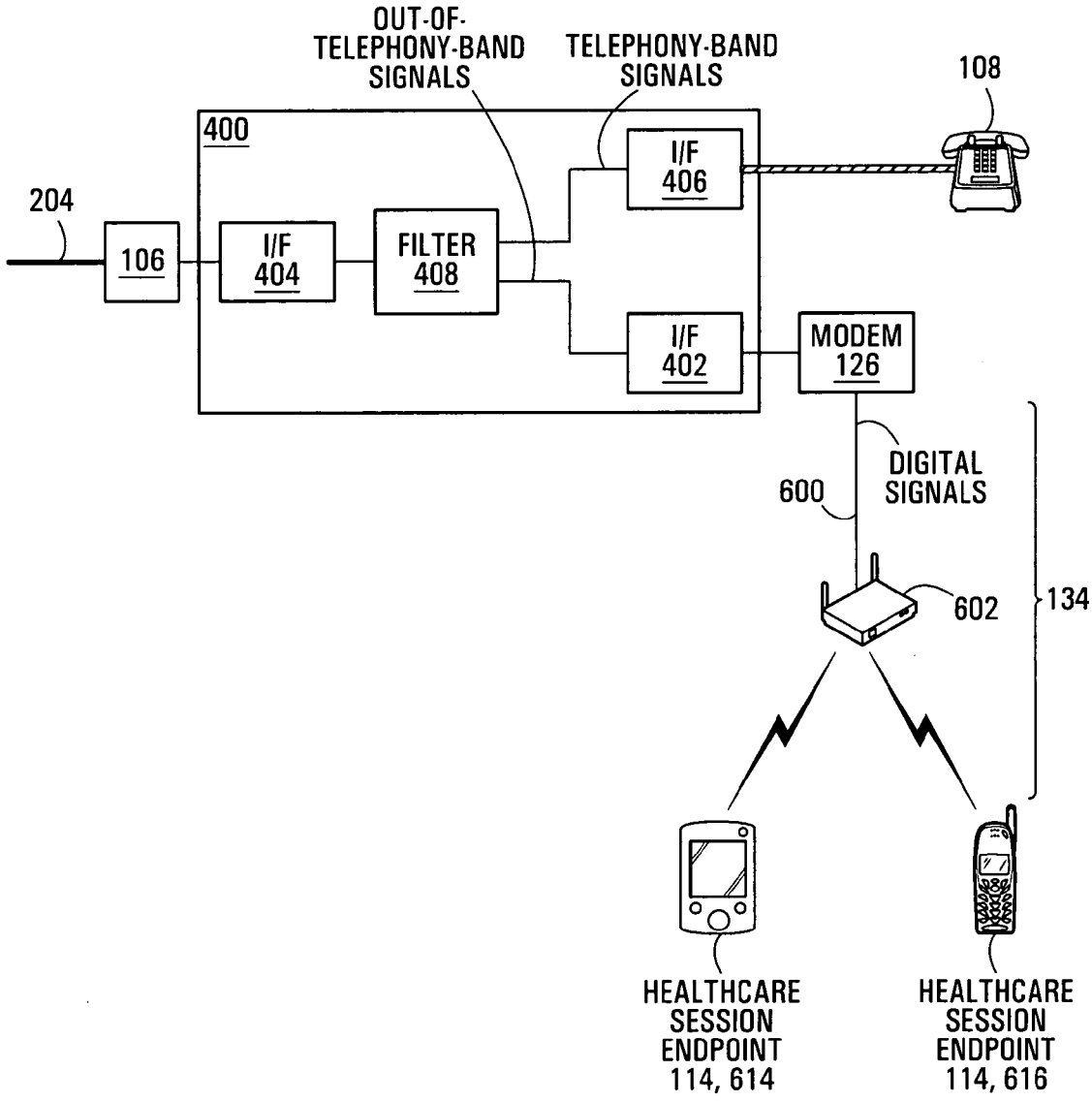
FIG. 6 is a block diagram showing a communication link between a remote modem and a plurality of wireless user devices.

A final transport leg for carrying data associated with healthcare information sessions established between the HIS server 110 and a particular one of the user devices 114 is provided by a communications link 134 between the remote modem 126 and the particular user device itself. As previously mentioned, the user devices 114 can take on many forms, and these can be classified into two basic categories, namely fixed-wire and wireless. In the fixed-wire case, shown in FIG. 5, the communication link 134 is a wireline link 500, such as an Ethernet cable, which communicatively couples the remote modem 126 to a user device 114, which can be a fixed-wire terminal 514 or computer on wheels (COW), for example. In the wireless case, shown in FIG. 6, the communication link 134 is a wireline link 600 up to a wireless access point 602 connected to the remote modem 126. The wireless access point 602 establishes a wireless local area network (WLAN) between itself and one or more of the wireless user devices 114 in the vicinity and capable of maintaining wireless communication with the wireless access point 602. The user devices 114 in this case may include personal digital assistants 614, laptop and tablet computers and WLAN telephones 616, to name a few, as well as custom composite devices possibly also including bar code scanning technology. It will be apparent from the foregoing that the communication link 134 between the remote modem 126 and the user device(s) involved in a healthcare information session may, in some instances, be wireless at least in part.

In addition to transporting data associated with healthcare information sessions, the out-of-telephony-band signals traveling over the telephony infrastructure 100 may carry other types of data, hereinafter referred to as ancillary data. For example, ancillary data may include VoIP data and/or patient entertainment data.

Figure 7:
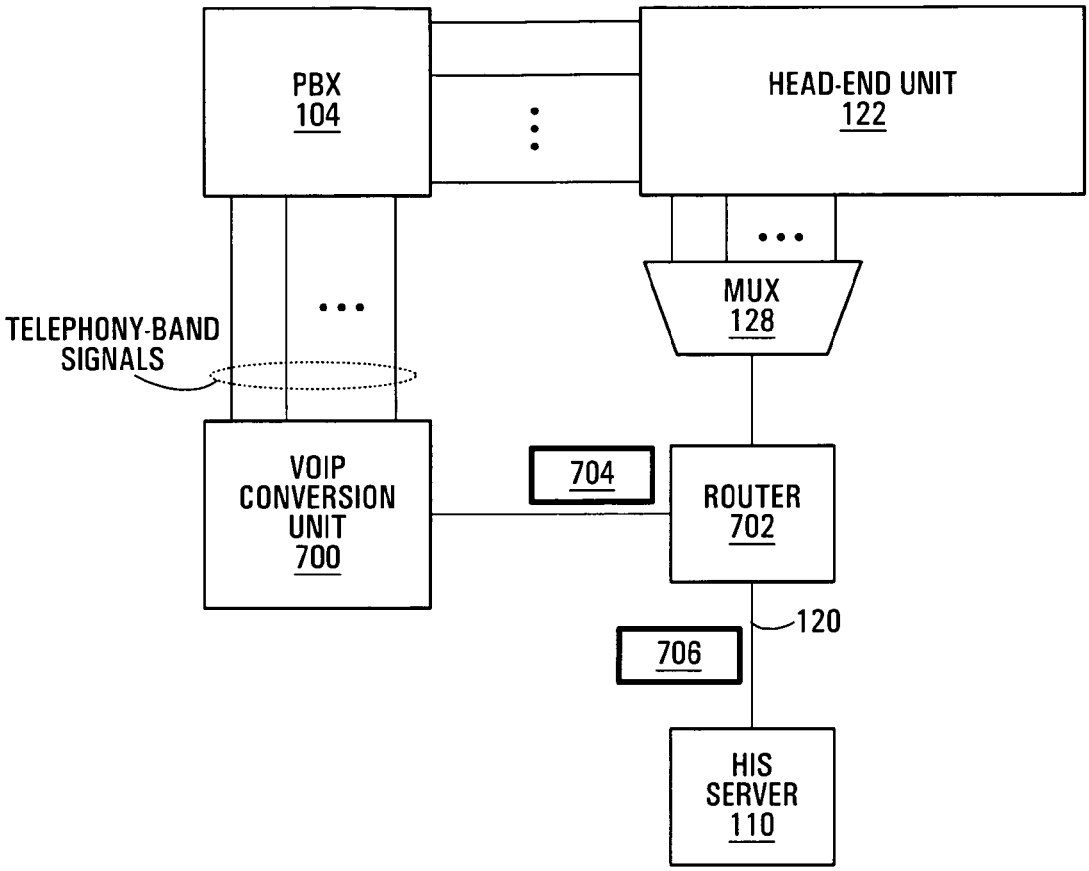
FIG. 7 is a block diagram of the communications system of FIG. 1 with VoIP conversion functionality.

In the case of VoIP data, now described with reference to FIG. 7, an embodiment of the communications system of the present invention provides a VoIP conversion unit 700 connected between the PBX 104 and a router 702 in the high-speed link 120. The VoIP conversion unit 700 is operative to convert telephony-band signals to VoIP packets 704 and vice versa as is known to those skilled in the art. The router 702 at the HIS server 110 mixes the VoIP packets 704 destined for the user devices 114 with healthcare information session data packets 706 also destined for the user devices 114. In the opposite direction of information flow, the router receives, from the head-end unit 122, a mix of packets including VoIP packets 704 and healthcare information session data packets 706 originating from the user devices 114. The router 702 distinguishes the VoIP packets 704 from the healthcare information session data packets 706 (for instance by their address, their origin or by an embedded class mark), and routes the VoIP packets 704 towards the VoIP conversion unit 700, while routing the healthcare information session data packets 706 towards the HIS server 110.

Figure 8:
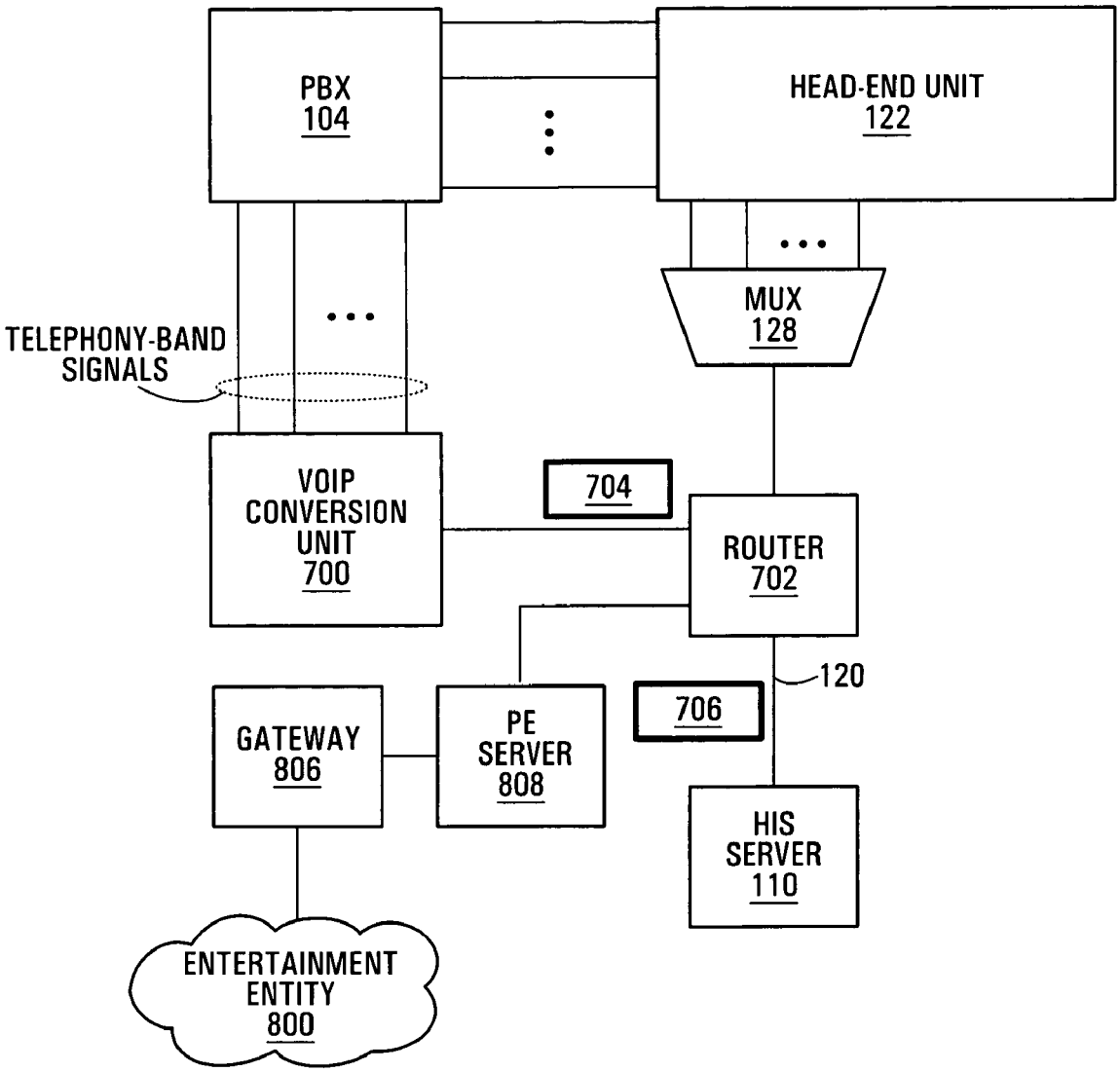
FIG. 8 is a block diagram of the communications system of FIG. 7 with the capability to deliver non-healthcare services from an external source.

In the case of patient entertainment data, now described with reference to FIG. 8, the communications system provides links to an entertainment entity 800, such as a broadcast source, a cable source and/or the Internet. The entertainment entity 800 is accessed via a gateway 806. A patient entertainment (PE) server 808 is connected to the gateway 806 and manages patient entertainment session(s) established with the user device 114. Clearly, in this embodiment, the user devices 114 are not limited to devices exclusively used by healthcare workers. Rather, the user devices 114 as envisaged here are capable of being accessed by patients and/or their visitors, and include (without being limited to) bedside terminals and WLAN wireless telephones. In some cases, the user devices 114 will be accessible by both healthcare workers and non-healthcare workers, and are thus capable of establishing healthcare information sessions with the HIS server 110 or patient entertainment sessions with the PE server 808. For further information as to authentication and other security issues which arise when the potential user of an end user device may belong to one of several classes of users, the reader is referred to U.S. patent application Ser. No. 10/813,230 entitled "Integrated And Secure Architecture For Delivery Of Communications Services In A Hospital" to Graves et al., filed Mar. 31, 2004, hereby incorporated by reference herein.

A router 802 in the high-speed link 120 mixes entertainment packets 804 destined for the user devices 114 with healthcare information session packets 706 (and possibly VoIP packets 704) also destined for the user devices 114. In the opposite direction of information flow, the router 802 receives a mix of packets including entertainment packets 804, healthcare information session packets 706 and possibly also VoIP packets 704 originating from the user devices 114. The router 802 separates out the entertainment packets 804 and routes them towards the PE server 808 and the entertainment entity 800, while routing VoIP packets 704 and the healthcare information session packets 706 as described above with reference to the router 702.

Figure 9:
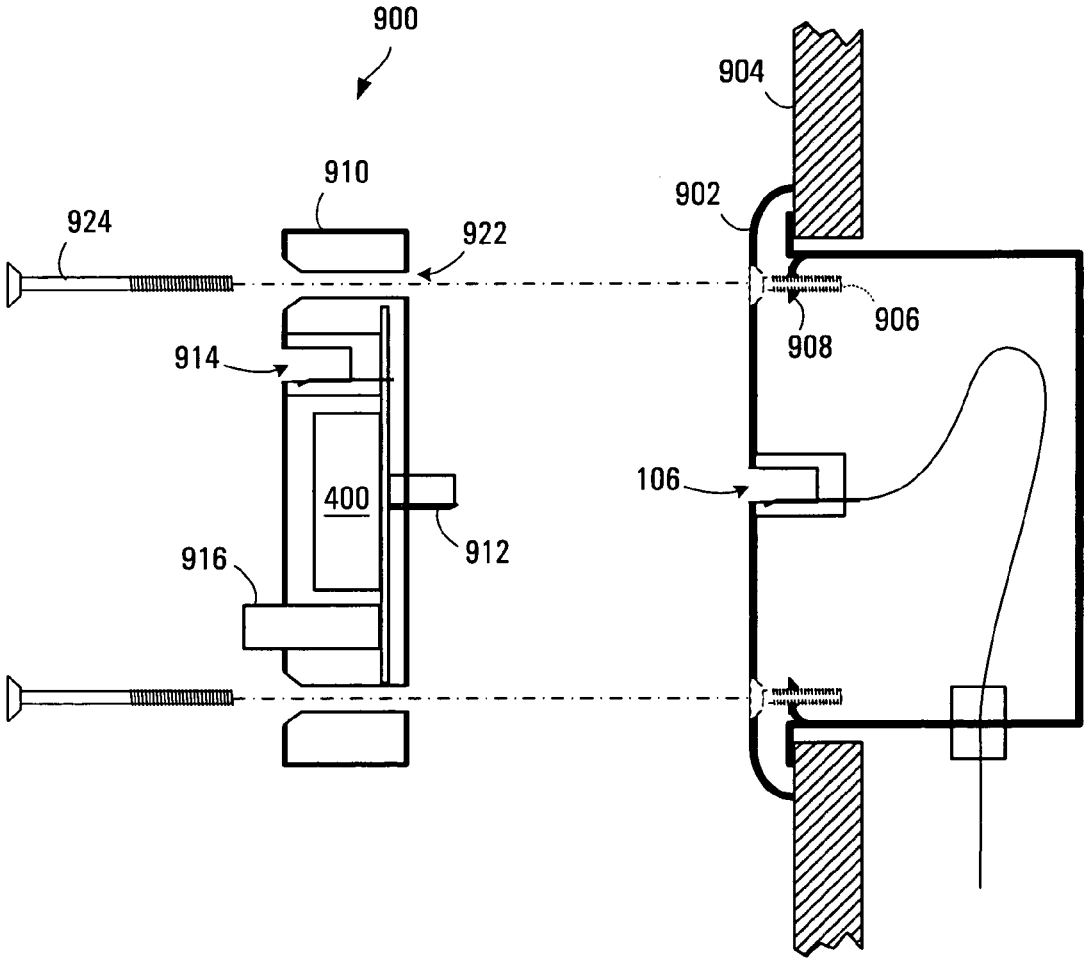
FIG. 9 is a sectional view of an overlay that fits over a standard wall jack, for providing two connections, one to a telephone and another to a remote modem.

Those skilled in the art will appreciate from the foregoing that in order to provide the delivery of healthcare information sessions to a particular room in the hospital, all that is required is the installation of a remote modem 126 in communication with a wall jack 106 in that room. This installation process, which re-utilizes a telephony infrastructure not necessarily designed for data delivery to the POC, has the advantage of being non-disruptive, as "unclean" areas of the hospital (such as the insides of walls and the space above suspended ceilings) do not need to be opened up to install new high-speed data-optimized wiring such as Cat 5 Ethernet cabling. In addition, the noise, dust and general inconvenience to staff associated with the opening up of such spaces is avoided. Meanwhile, telephony service is provided in the same manner as before the installation of the remote modem 126. Specifically, a telephone 108 which would ordinarily have been plugged into the wall jack 106 can now be connected to the interface 406 of the remote combiner-splitter module 400. For this to be as transparent as possible to the pre-existing telephony service offering, it is advantageous for the interface 406 to provide a socket that is physically and electrically compatible with the wall jack 106. A solution for achieving this is now described with reference to FIG. 9.

Specifically, there is provided an overlay 900 for a standard wall jack 106 that is adapted to receive a telephony plug of a standard type, such as RJ-11. Typically, the wall jack 106 is defined in a plate 902 affixed to the wall 904 (or other architectural structure) by a number of fasteners 906 (e.g., screws) received in respective receiving areas 908 (e.g., threaded apertures) in the wall 904. In the case of RJ-11 and other standard telephony plugs, the plug is secured into the wall jack 106 by means of a deformable plastic tang providing a positive lock. The tang mechanism tends to be physically fragile and, if broken, it will still permit the engagement of the RJ-11 telephony plug into the wall jack 106, but it will not provide a positive lock of the plug with respect to the wall jack 106.

The overlay 900 has a housing 910 with an interior face that faces towards the wall 904 and an exterior face that faces away from the wall 904. A telephony plug 912 is affixed to the interior face of the housing 910. The telephony plug 912 is similar to the telephony plug which the wall jack 106 is adapted to receive. In the case where the standard telephony plug is RJ-11, for example, then the telephony plug 912 may be identical to an RJ-11 plug except that a plastic tang is not required, since securing of the housing 910 to the wall 904 is guaranteed by other means (to be described later on with reference to fasteners 924).

In addition, the overlay 900 provides a telephony socket 914 integrated to the housing 910 and accessible from the exterior face of the housing 910. The telephony socket 914 is adapted to receive a telephony plug of the same type as the telephony plug which the wall jack 106 was adapted to receive. In the example of an RJ-11 telephony plug, it is envisaged that such a telephony plug will be secured in the telephony socket 914 by way of its plastic tang in the usual manner.

The overlay 900 also provides a high-speed connector 916 integrated to the housing 910, for connection to a mating connector (not shown) leading to the interface 402 and the remote modem. The high-speed connector 916 can be accessed from the exterior face of the housing 910.

The telephony plug 912, the telephony socket 914 and the high-speed connector 916 are electrically connected to the previously described combiner-splitter module 400, which is disposed within the housing 910. Specifically, the combiner-splitter module 400 is configured to allow telephony-band signals to be exchanged via the telephony socket 914, to allow out-of-telephony-band signals to be exchanged via the high-speed connector 916 and to allow composite signals comprising the telephony-band signals and the out-of-telephony-band signals to be exchanged via the telephony plug 912. In one embodiment, the combiner-splitter unit 400 is a passive electrical filter which does not require an external source of power. In another embodiment, the combiner-splitter unit 400 is active and is powered by the act of inserting the telephony plug 912 into the wall jack 106 when the latter is energized.

It is noted that when a standard telephony plug is inserted into the telephony socket 914 while the telephony plug 912 is inserted into the wall jack 106, the electrical connectivity provided by the combiner-splitter module 400 is the same as if that same standard telephony plug were inserted into the wall jack 106 in the absence of the overlay 900.

It is also noted that the high-speed connector 916 and its mating connector provide a lock mechanism that is designed to be more resistant to tension-induced disconnect than the telephony socket 914. For example, instead of the plastic tang used to secure an RJ-11 plug in the telephony socket 914, the mating connector could be designed to be removable from the high-speed connector 916 by unscrewing a nut. This reduces the probability of a catastrophic interruption of a potentially mission-critical healthcare information session, due to inadvertent pulling on the data cable.

In order to mount the overlay 900 to the wall 904, the housing 910 has a number of receiving areas 922 at least as great as the number of fasteners 906 used to affix the plate 902 to the wall 904 (while the telephony plug 912 is received in the wall jack 106). In a specific embodiment, the receiving areas 922 in the housing 910 are aligned with the receiving areas 908 in the wall 904. The receiving areas 922 receive a respective number of replacement fasteners 924 (e.g., screws) that affix both the overlay 900 and the plate 902 to the wall 904 when the replacement fasteners 924 are received in the receiving areas 908 of the wall 904. As an example, there may be two replacement screws 924, and the replacement screws 924 may be similar to the screws 906, only longer.

While specific embodiments of the present invention have been described and illustrated, it will be apparent to those skilled in the art that numerous modifications and variations can be made without departing from the scope of the invention as defined in the appended claims.

What is claimed is:

1. An overlay for a wall jack adapted to receive a telephony plug of a specific type, comprising:

a housing having an interior face and an exterior face;

a telephony plug on the interior face of the housing, the telephony plug suitable for insertion into the wall jack;

a telephony socket integrated to the housing and accessible from the exterior face of the housing, the telephony socket being adapted to receive a telephony plug of the specific type, wherein when receiving the telephony plug of the specific type, the telephony socket providing a resistance to tension-induced disconnect of the telephony plug of the specific type;

a high-speed connector integrated to the housing for connection to a mating connector leading to a digital apparatus, the high-speed connector and the mating connector being rotatably secured together, thereby providing a resistance to tension-induced disconnect of the mating connector;

the resistance to tension-induced disconnect of the mating connector being greater than the resistance to tension-induced disconnect of the telephony plug of the specific type;

a combiner-splitter unit electrically connected to the telephony plug, to the telephony socket and to the high-speed connector.

2. The overlay defined in claim 1, wherein the combiner-splitter unit is operative to allow telephony-band signals to be exchanged via the telephony socket, to allow out-of-telephony-band signals to be exchanged via the high-speed connector and to allow composite signals comprising the telephony-band signals and the out-of-telephony-band signals to be exchanged via the telephony socket.

3. The overlay defined in claim 1, wherein the wall jack is defined in a plate affixed to an architectural structure by a number of fasteners received in respective receiving areas in the architectural structure, wherein said housing comprises a number of receiving areas at least as great as said number of fasteners and configured to receive a respective number of replacement fasteners that affix both said overlay and the plate to the architectural structure when received in the receiving areas of the architectural structure.

4. The overlay defined in claim 3, wherein the fasteners are screws of a first length and wherein the replacement fasteners are screws of a second length greater than the first length.

5. The overlay defined in claim 4, wherein the number of fasteners and replacement fasteners is both two.

6. The overlay defined in claim 1, wherein the telephony plug is an RJ-11 plug and wherein the telephony socket is an RJ-11 socket.

7. The overlay defined in claim 1, wherein the combiner-splitter unit is passive.

8. The overlay defined in claim 1, wherein the combiner-splitter unit is active and is powered by the telephony plug being inserted into the wall jack when the wall jack is energized.

9. The overlay defined in claim 1, wherein said providing a resistance to tension-induced disconnect of the telephony plug of the specific type comprises hooking onto a tang on the telephony plug of the specific type.

10. The overlay defined in claim 9, wherein said providing a resistance to tension-induced disconnect of the mating connector comprises roatably securing a nut on one of the high-speed connector and the mating connector.

11. The overlay defined in claim 1, the electrical connection between the combiner-splitter unit, the telephony plug, the telephony socket and the high-speed connector providing for equivalent electrical connectivity between (I) insertion of a telephony plug of the specific type into the telephony socket while the telephony plug is inserted into the wall jack and (II) insertion of a telephony plug of the specific type into the wall jack in the absence of said overlay.

12. The overlay defined in claim 2, wherein the wall jack is defined in a plate affixed to an architectural structure by a number of fasteners received in respective receiving areas in the architectural structure, wherein said housing comprises a number of receiving areas at least as great as said number of fasteners and configured to receive a respective number of replacement fasteners that affix both said overlay and the plate to the architectural structure when received in the receiving areas of the architectural structure.

13. The overlay defined in claim 12, wherein the fasteners are screws of a first length and wherein the replacement fasteners are screws of a second length greater than the first length.

14. The overlay defined in claim 13, wherein the number of fasteners and replacement fasteners is both two.

15. The overlay defined in claim 2, wherein the telephony plug is an RJ-11 plug and wherein the telephony socket is an RJ-11 socket.

16. The overlay defined in claim 2, wherein the combiner-splitter unit is passive.

17. The overlay defined in claim 2, wherein the combiner-splitter unit is active and is powered by the telephony plug being inserted into the wall jack when the wall jack is energized.

18. The overlay defined in claim 2, wherein said providing a resistance to tension-induced disconnect of the telephony plug of the specific type comprises hooking onto a tang on the telephony plug of the specific type.

19. The overlay defined in claim 18, wherein said providing a resistance to tension-induced disconnect of the mating connector comprises rotatably securing a nut on one of the high-speed connector and the mating connector.

20. The overlay defined in claim 2, the electrical connection between the combiner-splitter unit, the telephony plug, the telephony socket and the high-speed connector providing for equivalent electrical connectivity between (I) insertion of a telephony plug of the specific type into the telephony socket while the telephony plug is inserted into the wall jack and (II) insertion of a telephony plug of the specific type into the wall jack in the absence of said overlay.

* * * * *